US005857524A

United States Patent [19]

Harris et al.

[11] Patent Number: 5,857,524

[45] Date of Patent: Jan. 12, 1999

[54] LINER HANGING, SEALING AND CEMENTING TOOL

[76] Inventors: Monty E. Harris, 501 Twilla Trail, Azle, Tex. 76020; Patrick C. Hyde

[21] Appl. No.: 806,710

[22] Filed: Feb. 27, 1997

[51] Int. Cl.[6] ..... E21B 43/10

[52] U.S. Cl. ..... 166/382; 166/208; 166/216

[58] Field of Search ..... 166/382, 208, 166/138, 216, 123

[56] References Cited

U.S. PATENT DOCUMENTS

| | | | |
|---|---|---|---|
| 3,398,795 | 8/1968 | Elliston | 166/123 |
| 3,519,074 | 7/1970 | Berryman | 166/123 |
| 4,489,781 | 12/1984 | Weeks | 166/208 |
| 4,572,290 | 2/1986 | Clifton | 166/123 |
| 4,690,220 | 9/1987 | Braddick | 166/382 |
| 5,327,964 | 7/1994 | O'Donnell et al. | 166/208 |

OTHER PUBLICATIONS

"Lindsey Means Liner Hangers" brochure by Lindsey Completion Systems, 1983.

General Catalog by Lindsey Completion Systems, 1990.

*Primary Examiner*—Hoang Dang

*Attorney, Agent, or Firm*—James E. Bradley

[57] ABSTRACT

A liner hanger will actuate remotely in a well to support a liner in casing. A running tool is secured to drill pipe and attached to the upper end of the liner. The liner hanger mounts to the exterior of the liner and includes a pair of tapered wedge members mounted in opposition to each other. The lower wedge member is stationarily secured to the liner for movement with it. The upper wedge member is carried in an extended running-in position by a retainer. A stop member is mounted above the lower wedge member by a connector. The connector secures the stop member to the liner for movement with it while running-in. Once on bottom, the stop member is released from the connector by stroking the drill pipe. Continued upward movement of the drill pipe will be relative to the stop member because it will engage the casing to remain stationery with the casing. The wedge members will move upward, with the upper wedge member contacting the stop member and being prevented from further upward movement. The retainer shears, allowing the lower wedge member to continue upward movement, sliding and wedging against the upper wedge member to lock the liner to the casing.

20 Claims, 8 Drawing Sheets

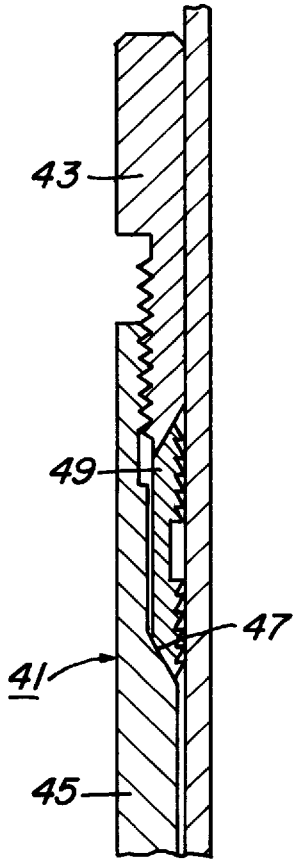
Fig. 3
Fig. 4
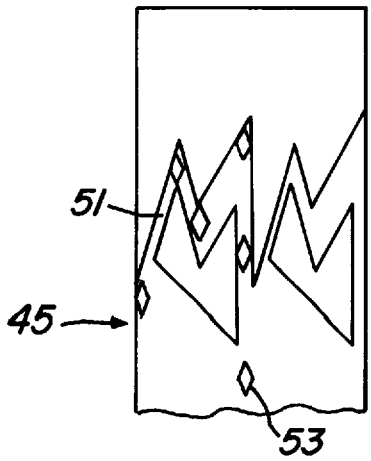

LINER HANGING, SEALING AND CEMENTING TOOL

FIELD OF INVENTION

This invention deals with an apparatus designed to hang off and cement, oil, gas, thermal or any well liner.

BACKGROUND ART

In well drilling, particularly for oil or gas, casing is cemented in the well to seal off the formation. For pressure control and the protection of fresh water formations, the well will have multiple strings of casing, each string of casing being smaller in diameter than the one above. In one technique, each string of casing extends completely to the surface where it is supported at a wellhead by a casing hanger. In another technique, liners are employed. A liner is a string of casing that will overlap the next upward string of casing, but will not extend completely to the surface. This avoids additional costs of several strings of concentric casing in the shallower portions of the well.

The upper end of the liner has to be remotely attached by a liner hanger to the casing, normally near the lower end of the casing. When installing a liner, normally a special section of pipe, called a mandrel, will be attached to the upper end of the liner. The mandrel will be machined to accept the liner hanger assembly. Because the mandrel must have a performance rating equal to the pipe of the liner, normally the customer will supply for machining a section of the actual liner to be used. A running tool will engage the mandrel, and the entire assembly will be lowered into the well. After the liner reaches bottom, the operator will actuate the liner hanger to secure the mandrel to the casing.

The operator will cement the liner into the well, in some cases before actuating the liner hanger, on other cases after. Usually a cement bushing will be employed with the running tool to locate inside the mandrel. This cement bushing engages the mandrel to support the running tool and drill pipe against an upward force that occurs while pumping the cement down the drill pipe. After the cement has set and the liner hanger has been set, the operator withdraws the running tool and cement bushing. The mandrel and liner hanger assembly will remain in the well.

There are many different types of liner hangers and different techniques employed for setting liner hangers. In one technique, hydraulic force is used to set the liner hanger. The hydraulic force may be supplied by pumps on the rig pumping down the drill pipe. The flow must be diverted through a fluid port in the running tool and the mandrel to apply the fluid pressure to the liner hanger on the exterior of the mandrel. The flow is diverted by dropping a ball or dart from the surface, which opens and closes various passages once seated. A considerable amount of time is required for the ball to reach the running tool, often several hours. During this time period, the operator is normally unable to circulate fluid through the liner. If the liner has not already been cemented in place, keeping the liner stationary in an open hole without the ability to circulate can be dangerous.

In another hydraulic type, hydraulic force is supplied by a hydraulic chamber exposed to wellbore fluids. The operator must raise and lower the drill pipe to provide the increased pressure. This system may prevent the operator from raising and lowering the drill pipe prior to setting for other purposes.

Other liner hangers are operated mechanically, which involves rotating and moving the drill pipe axially to actuate the liner hanger. For example, J-pins and J-slots may be employed which, when rotated, move the liner hanger to different positions. In highly deviated wells, it is difficult to rotate the drill pipe. Other mechanical running tools do not have the ability for the operator to stroke the liner up and down after the liner reaches bottom without causing setting of the hanger. As a result, the operator may be unable to reciprocate the liner during cementing, which often is a good procedure to follow.

The requirement of specially prepared mandrels is a disadvantage. The machining is done at a shop, not in the field. Consequently, delays may occur, and it is costly to ship the liner section to a shop and back to a wellsite. Moreover, in some costly corrosion-resisting casing strings, machining may damage the properties of the mandrel. Inspections are necessary to make sure that the machining operations have not harmed the metal of the pipe.

Additionally, in very long liners it may be desired to spread the load support by the liner hanger to the casing at various points along the overlapped region. Liner hangers used, however, support the liner only at the top of the liner. Other liner hanger systems and running tools may not have the ability to automatically fill the drill pipe while the liner is being run. The customer may prefer to have the drill pipe filled while being run. If so, then the customer must manually fill it from the drill rig, which takes additionally time.

DISCLOSURE OF INVENTION

The liner hanger of this invention operates with conventional casing or liner. No specially prepared mandrel at the top is needed. The running tool inserts into the upper end of the mandrel. The running tool has a cone and slips arrangement whereby simply pulling upward will cause the running tool to grip and support the weight of the liner.

The liner hanger mounts to the exterior of the liner. The hanger includes a pair of wedge members, the lower of which is mounted stationarily to the liner. The upper wedge member is mounted to the lower wedge member by a retainer that holds the upper wedge member in a stationary position during running-in. A stop member is mounted above the upper wedge member. The stop member is secured to the liner by a connector. In the running-in position, the connector holds the stop member stationary with the liner.

After landing on bottom, the stop member is released from the connector, preferably by slacking off and pulling the drill pipe. The stop member has a drag spring which engages the casing. After the stop member has been released and engaged the casing, raising the drill pipe brings the upper wedge member into contact with the stop member, which grips the casing and prevents further upward movement of the upper wedge member. The retainer which held the upper wedge member in the running-in position releases the upper wedge member, allowing the liner to continue upward movement. This causes the lower wedge member to advance against the upper wedge member, tightly gripping the casing and the liner.

Cementing may occur either before or after the liner hanger is set. A cement bushing extends into the liner and is supported in the liner on a mandrel extending downward from the running tool. Stroking the running tool will set seals and slips for the cement bushing to releasably lock the cement bushing and thus the running tool and drill pipe to the liner. After cementing, stroking the drill pipe releases the cement bushing and running tool, allowing retrieval to the surface.

In the main embodiment, no rotation is required for running, setting and cementing the cement bushing. A number of alternate embodiments are also shown.

BRIEF DESCRIPTION OF DRAWINGS

FIG. 3 is a sectional view of a fastener portion of the of the liner hanger of FIG. 1.

FIG. 4 is a schematic view of a slot body portion of the liner hanger of FIG. 1.

DETAILED DESCRIPTION OF INVENTION

Figure 1A:
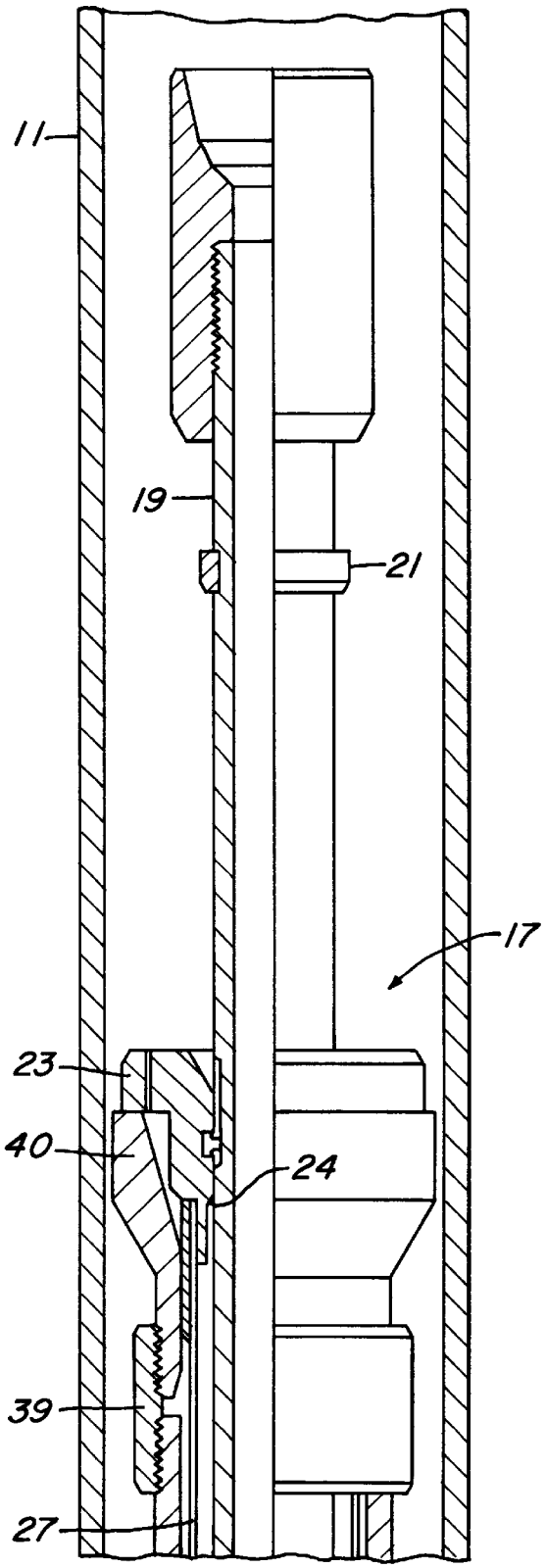
FIGS. 1A–1D comprise a sectional view of a liner hanger, running tool and cement bushing constructed in accordance with this invention.
Figure 1B:
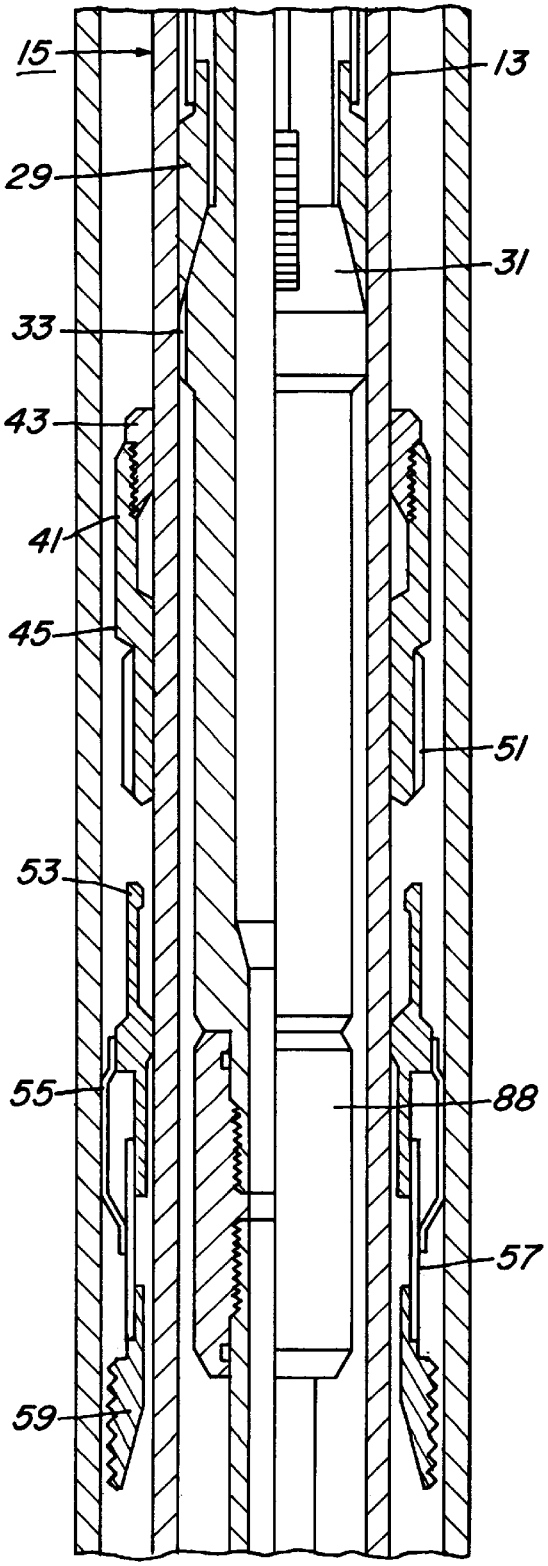
Figure 1C:
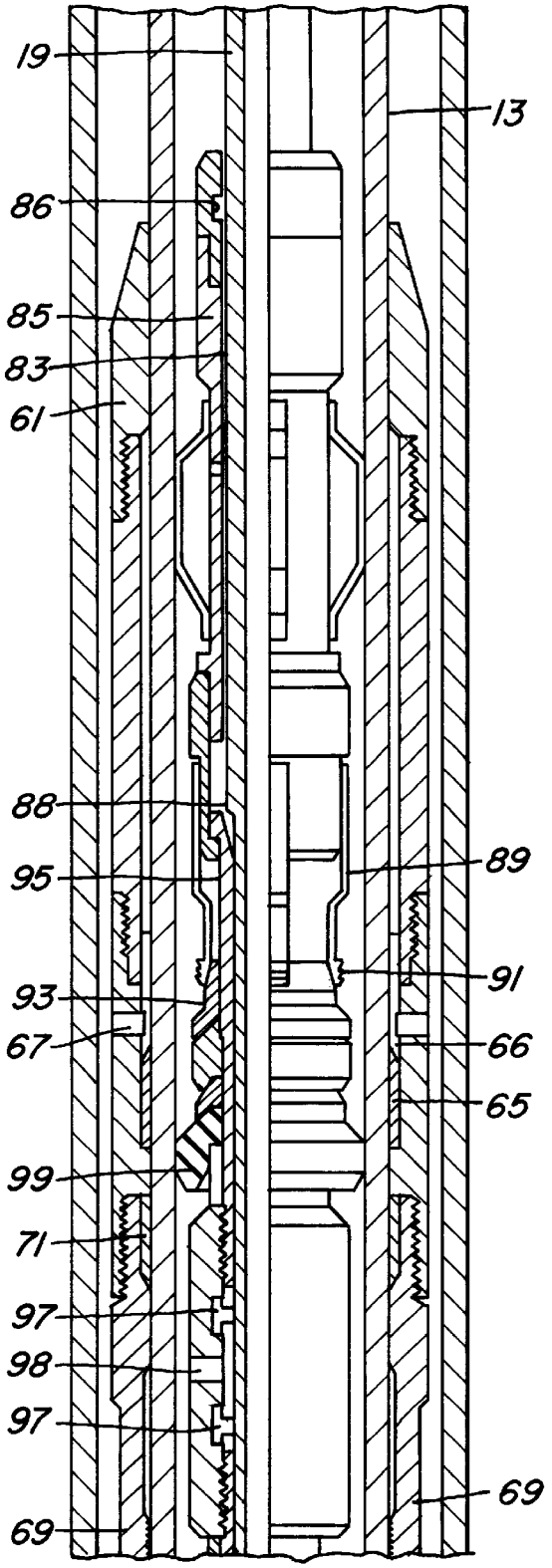
Figure 1D:
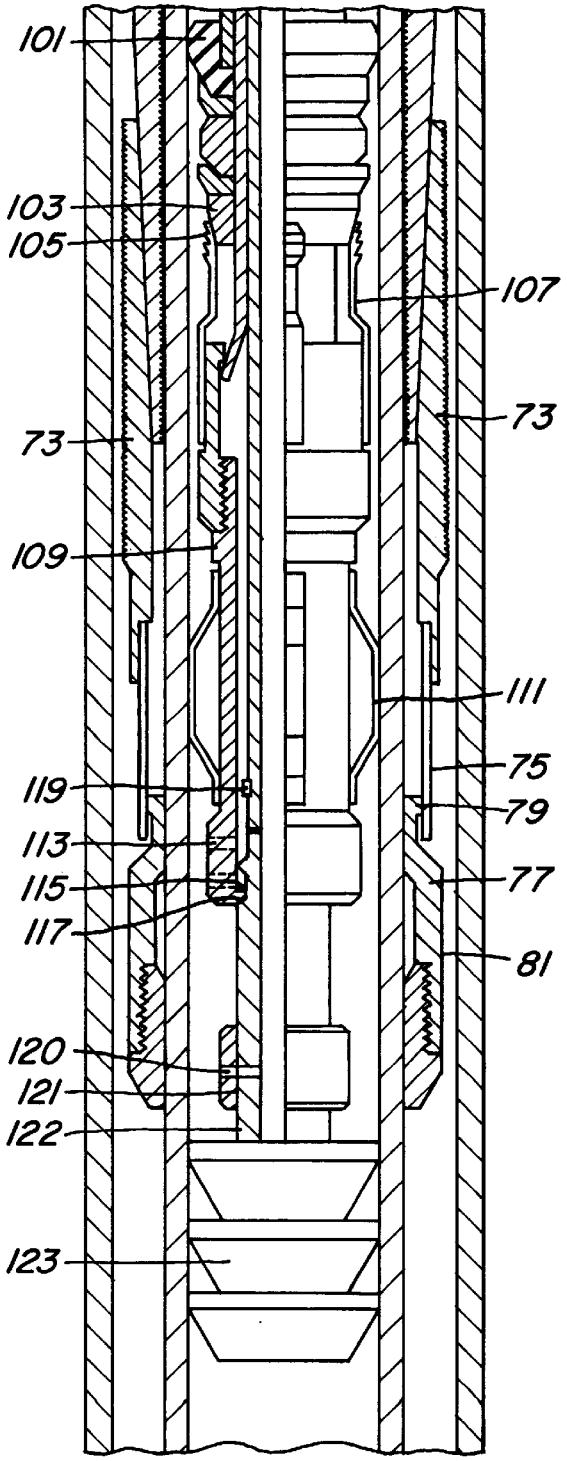

Referring to FIGS. 1A and 1B, a well contains a string of casing 11 which has been previously cemented in place. The well has been drilled deeper below casing 11, and the apparatus of this invention is being employed to run a liner 13 to the bottom or the well. Liner 13 is another string of casing of smaller diameter than casing 11. For example, casing 11 may be 9⅝ inches in outer diameter, and liner 13 and may be seven inches in outer diameter. Liner 13 needs no machining or other preparation for being hung in casing 13. Both liner 13 and casing 11 are conventional. Liner 13 will be lowered to the bottom of the open hole and the upper end of liner 13 will be located a selected distance above the bottom of casing 11. This overlap distance may be fairly short, or the operator may wish to suspend the upper end of liner 13 several thousand feet above the lower end of casing 11.

Liner 13 will be mechanically secured to casing 11 with a liner hanger 15 and cemented within the open hole. The cementing may take place after liner hanger 15 is set or before. Often, the operator will want the cement to flow up the annulus of the open hole and into the overlap or annulus between casing 11 and liner 13. If desired, the cement may be even be pumped to above the upper end of liner 13. In the event of a large overlap, several liner hangers 15 may be employed at various points along the annular space between casing 11 and liner 13 and set simultaneously. This may be desired for stress distribution. Liner hanger 15 not only supports the weight of liner 13 in casing 11 prior to setting of the cement, but it also grips casing 11 to prevent upward movement of liner 13 during cementing, which might otherwise occur due to high pressure pumping of cement up the annular space between casing 11 and liner 13. Liner hanger 15 also allows the passage of well fluid while running. Furthermore, in the event that it is necessary, downward or reverse circulation through the annulus between casing 11 and liner 13 may be performed.

Figure 2:
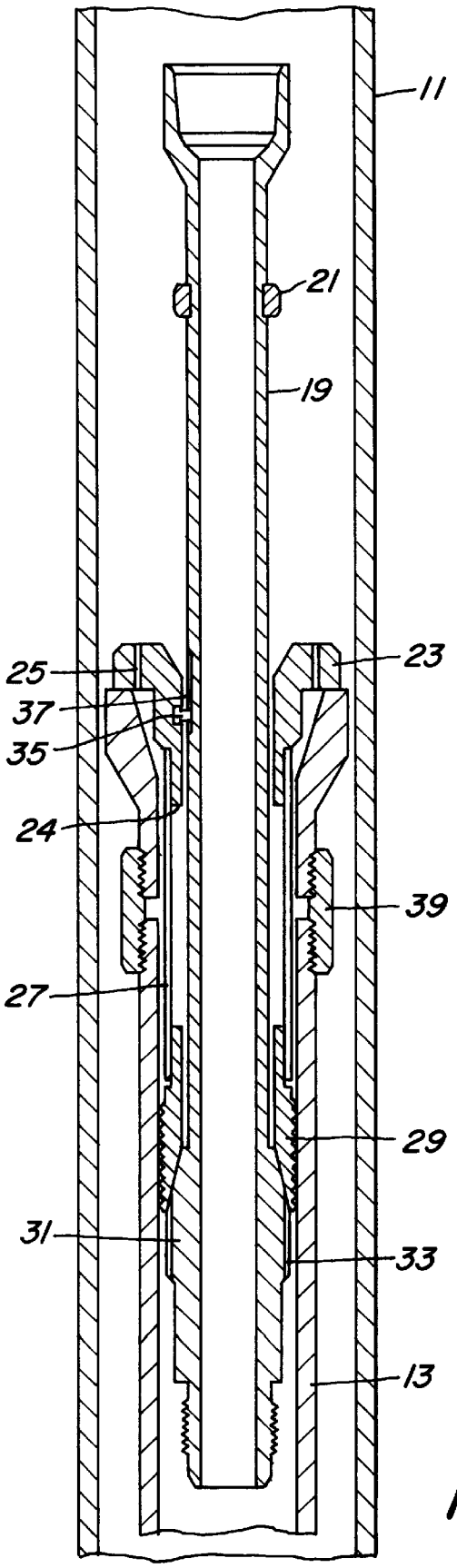
FIG. 2 is an enlarged sectional view of an upper portion of the running tool of FIG. 1.

Liner hanger 15 is mounted to running tool 17 which has a mandrel 19 that locates within the inner diameter of liner 13. Mandrel 19 is a tubular member that secures to a string of drill pipe (not shown) that extends to the rig floor. Mandrel 19 has the same inner diameter as the drill pipe. Referring also to FIG. 2, an outward biased split ring 21 is mounted in a recess in mandrel 19 above liner hanger 15. A collar 23 is slidingly carried on mandrel 19 below split ring 21. Collar 23 has a downward facing shoulder 24 on its inner diameter that will slide over split ring 21 for retrieval, as will be subsequently described. A passage 25 (FIG. 2) extends through collar 23 for circulation and automatic fill up of the drill pipe while being run in. This by-pass can be run closed if desired. A number of straps 27, which are metal braces spaced apart from each other, are secured to collar 23. Slips 29 are located at the lower ends of straps 27. Slips 29 engage a cone 31, which when moved upward into engagement with them, forces slips 29 outward to grip the inner diameter of liner 13 for supporting weight. When the drill pipe is picked up, mandrel 19 moves upward relative to collar 23, pushing slips 29 outward to grip liner 13 to support the weight of liner 13. Cone 31 has flutes 33 formed in it for circulation.

As shown in FIG. 2, a shear pin 35 is secured to the inner diameter of collar 23 for engaging an elongated recess 37 formed on mandrel 19. Recess 37 allows for some upward and downward movement of mandrel 19 relative to collar 23, so as to allow mandrel 19 to be picked up to move slips 29 into the gripping position without shearing shear pin 35. When it is time for retrieval, the operator applies sufficient downward weight of the drill pipe on mandrel 19 to shear pin 35. Continued downward movement of mandrel 19 relative to collar 23 causes split ring 21 to slide through collar 23 and locate below shoulder 24. Subsequent picking up of the drill pipe will pull collar 23 upward, but cone 31 will then be located below slips 29. Therefore slips 29 will not engage liner 13, allowing collar 23 and slips 29 to be retrieved along with mandrel 19.

Referring FIGS. 1A and 2, liner hanger 15 includes a liner coupling 39 that secures a tubular head 40 to the conventionally threaded upper end of liner 13. Collar 23 lands on head 40 while running-in. A connector or fastener 41 (FIG. 1A) is located below coupling 39. Although the drawing shows fastener 41 to be close to coupling 39, it will actually be located a few feet below. Fastener 41 is rigidly and permanently connected to the exterior of liner 13. Referring to FIG. 3, fastener 41 includes an upper body 43 and a lower body 45 which are secured together by threads. A recess is formed between bodies 43 and 45. The recess has cam surfaces 47 on the upper and lower ends. A set of slips 49, preferably two semi-cylindrical rings, are placed in the recess in engagement with cam surfaces 47. Tightening bodies 43, 45 to each other causes the slips 49 to tightly grip liner 13. Fastener 41 is secured to liner 13 while this portion of liner 13 is suspended at the rig floor.

Referring to FIG. 1 and FIGS. 3–5A, the lower portion of lower body 45 has a series of slots 51. Slots 51 are engaged by a pair of indexing fingers 53. The diamond shapes in FIG. 4 represent one of the fingers 53 at various positions along slots 51. There are two sets of slots 51, each in the configuration of an "M" At certain positions, fingers 53 will be trapped within slots 51. Upward and downward reciprocating motion, however, causes each finger 53 to move to the lowermost position schematically shown in FIGS. 1A and 5, wherein fingers 53 are completely free of slots 51. No rotation is required of the drill pipe from the rig floor to engage and disengage fingers 53 from slots 51. Simply moving the mandrel 19 axially relative to fingers 53 rotates fingers 53 as they index through the M-slots.

Figure 5A:
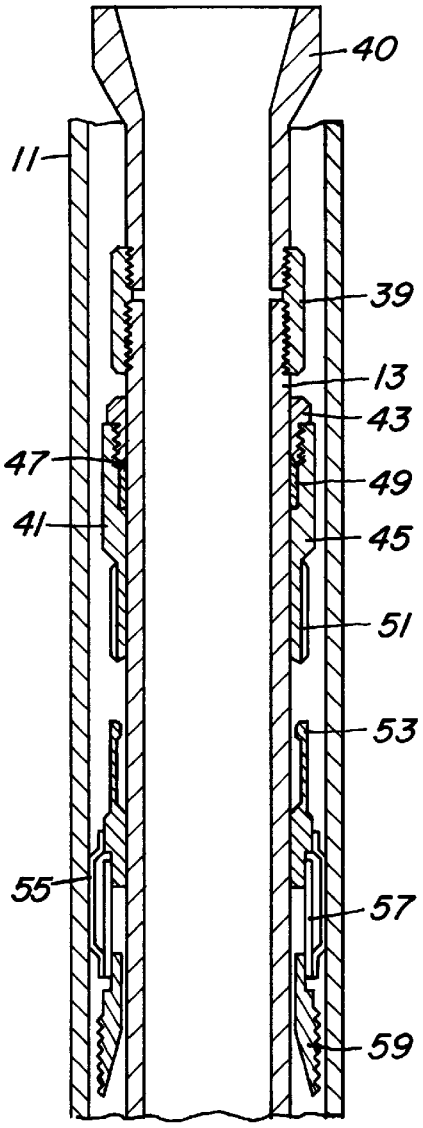
FIGS. 5A and 5B comprise an enlarged sectional view of the liner hanger of FIG. 1, with the running tool not being shown.

As shown in FIG. 1A and 5A, fingers 53 are secured to the upper end of a stop member or drag block member 55 which is slidingly carried on liner 13 below fastener 41. Drag spring 55 frictionally engages casing 11 at all times. While running liner 13 into the well, drag spring 55 will move in unison with liner 13 and slide on casing 11, with fingers 53 being located at unknown points within slots 51. It is not necessary to know at what particular points fingers 53 are located within slots 51. Simply picking up drill pipe 19 causes relative movement between slots 51 and fingers 53, because fingers 53 will be held stationary due to drag spring 55. One or two upward and downward movements of mandrel 19 after liner 13 is on bottom will result in fingers 53 disengaging from slots 51, allowing liner 13 to then be moved upward relative to fingers 53 and drag spring 55.

Figure 5B:
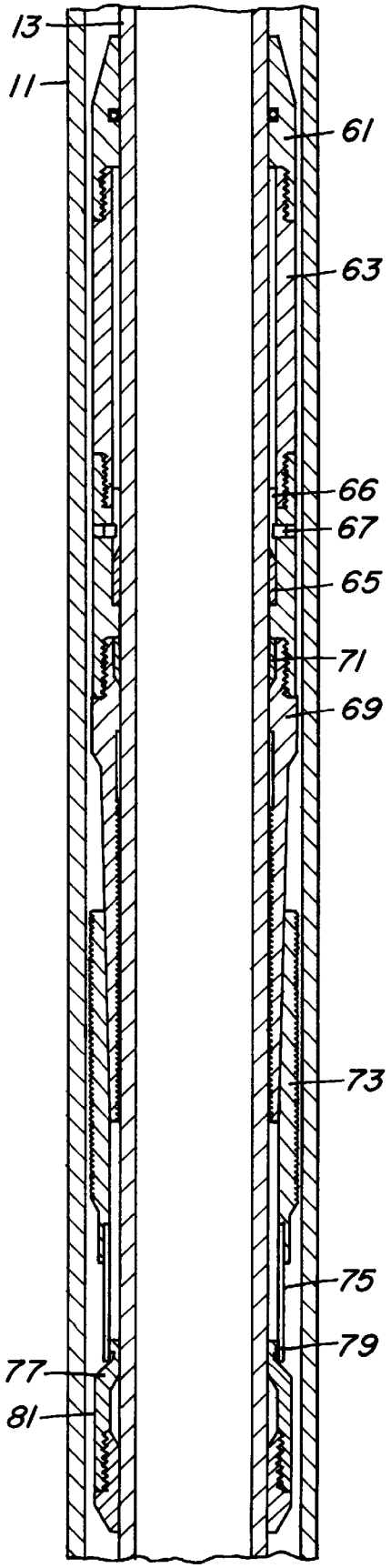

As shown in FIG. 5A, a series of straps 57 are secured to the lower end of the drag spring member 55. Straps 57 are connected to a series of slips 59, each of which has a tapered inner surface. Referring to FIG. 1B and 5B, while running liner 13 into the well, slips 59 will be located several feet above a cone 61, preferably about 10 feet. Cone 61 has an exterior tapered surface, is located on the exterior of liner 13 and moves with liner 13. If fingers 53 are disengaged from slots 51 by reciprocating of drill pipe, an upward pull of liner 13 of about ten feet will cause slips 59 to engage cone 61 because cone 61 will be moving upward with liner 13 while slips 59 remain stationary due to drag spring 55. When this occurs slips 59 will grip casing 11 and stop any continued upward movement of cone 61 in unison with liner 13.

Cone 61 is connected to a tubular member 63 which carries another set of body lock ring slips 65 for gripping liner 13. A shear block 66 is located just above body lock ring slips 65. Slips 65 are inward spring biased to engage liner 13 and are inclined to prevent upward movement of liner 13 relative to slips 65. A shear pin 67, which preferably shears at about 30,000 pounds, secures shear block 66 to body 63. A long upper collet cone 69 having teeth on its interior to serve as a slip is supported below body lock slips 65. Another set of body lock slips 71 is located within a recess in the upper portion of collet cone 69. Slips 71 allow upward movement of liner 13 relative to collet 69 but not downward. The outer surface of collet cone 69 is a smooth long conical taper. A lower collet 73 having a matching locking taper engages upper collet 69. Lower collet 73 has teeth on its exterior for gripping the inner diameter of casing 11. Relative movement of upper and lower collets 69, 73 toward each other from a running-in position to a contracted position causes tight gripping between casing 11 and liner 13, preventing movement in both upward and downward directions relative to each other. Lower slips 73 is secured by straps 75 to a retainer 77. Retainer 77 is connected by a shear pin 79 to a fastener 81. Fastener 81 is of the same type as fastener 41, shown in FIG. 3. Fastener 81 tightly and permanently secures lower collet 73 to liner 13.

Disclosing this portion of the operation, drill pipe is secured to mandrel 19 of running tool 17. When the operator picks up the drill pipe, mandrel 19 moves up, causing cone 31 to push slips 29 outward to grip liner 13 to support the weight of liner 13. The operator then lowers liner 13 into the well. Eventually, the lower end of liner 13 will reach the bottom of the well. Repetitive slacking off and picking up movement of the drill pipe will cause fingers 53 (FIG. 5A) to disengage from slots 51 due to drag springs 55 holding the fingers 53 stationary relative to casing 11. Once released, continued upward pull of mandrel 19 will cause cone 61 to move into engagement with slips 59, because fastener 81 causes upward movement of collets 69, 73. Once cone 61 contacts slips 59, it will not move any further upward with liner 13 because slips 59 jam into engagement with casing 11. Lower collet 73, however, continues to move upward, while upper cone collet 69, being attached to cone 61, is unable to move relative to casing 11.

An upward force is exerted on body lock ring slips 65 by lower collet 73 pushing against upper collet 69. However, slips 65 will not initially move upward relative to liner 13 because of shear block 66. Without more pull, upward movement of liner 13 will cease. To continue with the setting of liner hanger 15 the operator must continue to pull on the drill pipe in an amount that exceeds the amount required to shear pin 67. Consequently, an operator watching the weight indicator will know when shear pin 67 shears, informing him that liner hanger 15 is beginning to be permanently set. Up to this point, the operator can always move back to the initial running position with slips 59 spaced above cone 61 and with fingers 53 back in slots 51, to enable liner 13 to be retrieved upward relative to casing 11. Once the operator lowers the drill pipe, mandrel 19 and liner 13 back such that fingers 53 re-engage slots 51, then picking up again will cause slips 59 to move upward relative to cone 61, allowing retrieval of liner 13.

On the other hand, if the operator continues to pull upward and shears pin 67, the setting action of rigidly and permanently locking liner 13 to casing 11 begins to occur. This shearing allows the continued upward movement of liner 13 and lower collet 73 relative to upper collet 69. Once collets 69, 73 are in a contracted position, liner 13 and outer casing 11 will be rigidly locked together both in axial upward and downward movements. Because of locking tapers of collets 69 and 73, the setting is permanent.

Figure 6A:
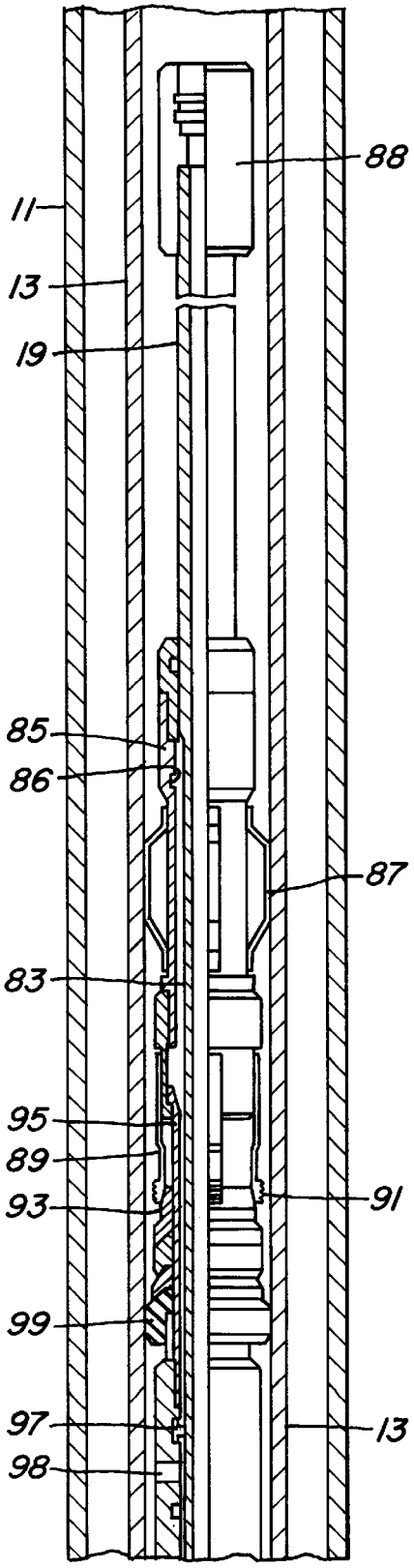
FIGS. 6A and 6B comprise an enlarged sectional view of the cement bushing of FIG. 1, with the liner hanger and running tool not being shown.
Figure 6B:
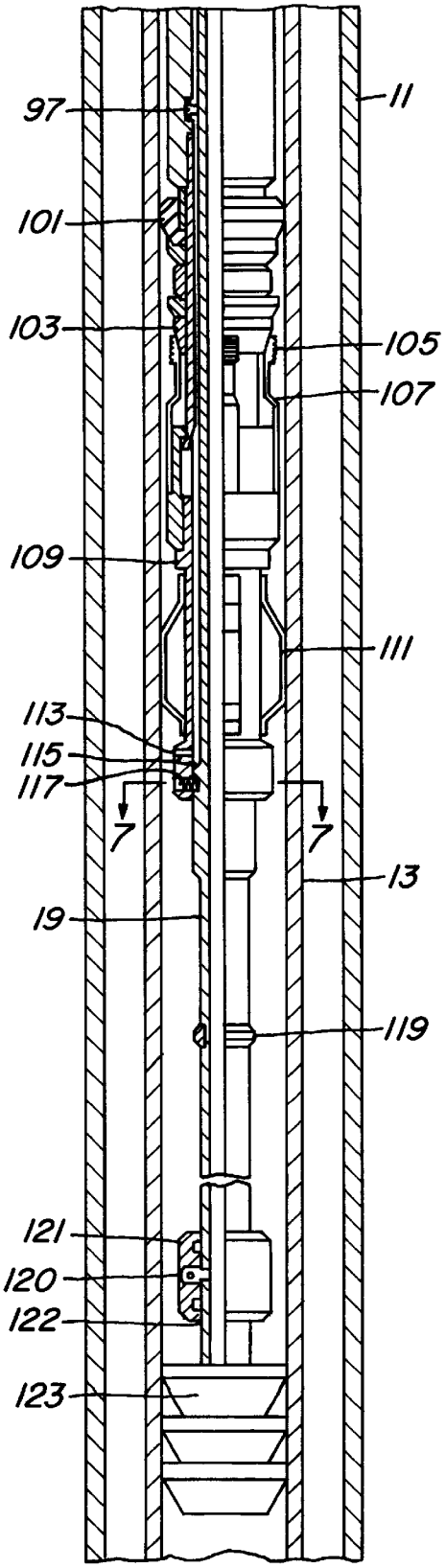

Referring to FIGS. 1B, 6A and 6B, a cement bushing 83 is carried on the inner diameter of liner 13. Cement bushing 83 is employed for the cementing operation, and will be retrieved after cementing has been completed. A main purpose of cement bushing 83 is to hold the drill pipe in liner 13 against the high upward force occurring during pumping of cement through the drill pipe and mandrel 19. Cement bushing 83 in this embodiment contains an upper body 85 which has drag springs 87 which frictionally engage the inner diameter of liner 13. An inner recess 86 is located at the upper end of upper body 85. An enlarged diameter seal area 88 is located on mandrel 19 below a shoulder and located above cement bushing 83 during running-in. A series of straps 89 connect upper body 85 to a set of slips 91. Slips 91 engage a cone 93. When cone 93 and slips 91 are moved toward each other, slips 91 will move out and grip the inner diameter of liner 13. Cone 93 is carried on a central body 95 which is carried by upper body 85. Inner annular clearances are provided between mandrel 19 and central and upper bodies 95 and 85 for circulation around mandrel 19. Seals 97 do not seal to mandrel 19 at this point, rather will seal to larger diameter portion 88 when mandrel 19 is moved downward during setting of cement bushing 83. A radial port 98 extends between the seals 97 to communicate the annular space between central body 95 and mandrel 19 with the space surrounding central body 95. A one way seal 99 is located above port 98. One-way seal 99 prevents upward flow of fluid in the annular space surrounding central body 95, but allows downward flow. Conversely, a one-way seal 101 is located below port 98. One-way seal 101 allows upward flow in the annular space between liner 13 and central body 95, but prevents downward flow. One-way seal 101 is located at the upper end of cone 103. Cone 103 is engaged by a set of slips 105 in a similar fashion to cone 93 and slips 91. A plurality of straps 107 connect cone 105 to a lower body 109.

Figure 7:
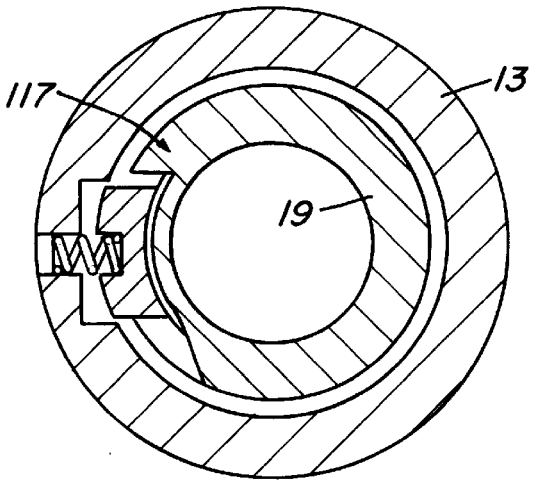
FIG. 7 is a sectional view of the cement bushing of FIG. 6, taken along the line 7—7 of FIG. 6B.

Lower body 109 has a drag spring member 111. A radial port 113 extends through lower body 109 to communicate fluid on the inner diameter of lower body 109 with the exterior. A lip 115 on the lower end of lower body 109 engages a high-low cam 117 (FIG. 7) to retain lower body 109 with mandrel 19. High-low cam 117 is a conventional mechanical member which has a locked position wherein lower body 109 is rigidly locked to mandrel 19. Rotating lower body 109 a short increment disengages lower body 109 to allow it to move axially relative to mandrel 19. While being installed at the rig floor, the operator will move high-low cam 117 to the free position.

An outwardly biased split ring 119 is located on mandrel 19 in a running-in position above high-low cam 117. When mandrel 19 is moved upward relative to lower body 109, split ring 119 will pass under lip 115 and move up the annular clearance between bodies 109, 95 and 85 and mandrel 19. Continued upward movement will eventually lodge split ring 119 in recess 86 (FIG. 6A) located at the upper end of upper body 85. Once split ring 119 engages recess 86, cement bushing 83 will be retrieved along with mandrel 19 after the cementing has been completed.

Referring again to FIG. 3 a check valve 121 is located at the lower end of mandrel 119. The body of check valve 121 is slidably mounted to an enlarged diameter area 122 on mandrel 19 that is the same in outer diameter as enlarged area 88. Check valve 121 allows downward flow of fluid in the annular space between mandrel 19 and liner 13 through port 120 to the interior of mandrel 19 but prevents reverse flow. A plurality of conventional cement plugs 123 (only one shown) are carried in liner 13. Cement plugs 123 are cup-shaped members which are carried at the lower end of mandrel 19 in liner 13. The lower end of mandrel 19 is located near the upper end of liner 13. Cement plugs 123 prevent fluid flowing down the annulus between liner 13 and mandrel 19 from flowing further downward. Although not shown, a conventional indicator plug pumped downward from the surface will engage plugs 123 and pump them to the bottom of liner 13. A conventional float shoe (not shown) is installed at the bottom of liner 13. The float shoe allows downward flow fluid, but has a check valve to prevent upward flow of fluid in liner 13.

In the operation of cement bushing 83, it will be installed while the upper end of liner 13 is suspended by slips at the rig floor. High-low cam 117 is rotated so that lip 115 will be free, allowing axial movement of mandrel 19 relative to lower body 109. Drill pipe is connected to mandrel 19 to lower the assembly into the well. While being lowered, the bore of mandrel 19 will fill automatically. Although the float shoe prevents upward flow in liner 13, well fluid is free to flow upward in the annular space between liner 13 and casing 11 while liner 13 is being lowered. This well fluid flows down passages 25 (FIG. 2) into the annular space between mandrel 19 and liner 13. The fluid flows down the annular space between the bodies 85, 95 and 109 and mandrel 19. The fluid flows through check valve 121 and port 120 into the interior of mandrel 19 for automatic filling of the drill pipe.

When liner 13 reaches the bottom of the well, the operator may set the liner hanger 15 first and then cement, or he may do it in reverse. The explanation of the setting of liner hanger 15 as explained above. If the operator sets liner hanger 15 after cementing, he is free to reciprocate and rotate liner 13 during the cementing process. To cement, he will first wish to circulate fluid down the drill pipe, then pump cement. However, he must first close off the circulation path in the annulus between the cement bushing bodies 85, 95 and 109 and the mandrel 19 and set the cement bushing 83. The retrievable setting of slips 91, 105 occurs by downward movement of mandrel 19 relative to liner 13. This occurs after liner 13 has landed on bottom and it can occur either before or after the setting of hanger assembly 15. After liner 13 has set on bottom, downward movement of the drill pipe and the mandrel 19 will not cause downward movement of upper body 85 with mandrel 19 because drag spring 87 will tend to hold it in engagement with the stationary liner 13. The enlarged diameter area 88 of mandrel 19 passes within upper body 85 and the shoulder at the upper end of area 88 causes upper body 85 to move downward with it once in engagement. Central body 95 will not move downward with the downward movement of mandrel 19 because of the one-way seals 99, 101, frictionally engaging the inner diameter of liner 13. This causes slips 91 to ride up over cone 93, gripping the inner diameter of liner 13. Any upward force acting on cone 93 will tend to even further push slips 91 into gripping engagement with liner 13, resisting an upward force occurring during pumping tending to push cement bushing 83 up from its set position. Mandrel 19 will move down far enough to position its enlarged diameter area 88 within seals 97. At the same time, drag spring 111 will be frictionally engaging the inner diameter of liner 13, tending to keep lower body 109 from moving downward with mandrel 19. Slips 105, when forced out by cone 103, will resist any downward force that might occur if reverse circulation is employed down casing 11. However, slips 105 do not set during this initial operation. Reverse circulation may be employed if during the cementing there are lost returns. This procedure will be explained subsequently. During normal cementing, reverse circulation is not employed and slips 105 will remain disengaged from liner 13.

When cement bushing 83 is set for cementing operations to occur, the circulation path through cement bushing 83 is closed. Downward circulation through the drill pipe and mandrel 19 will not flow through check valve 121. The fluid flows out the float shoe (not shown) and returns up the open hole annulus around liner 13. The upward flow passes through the annulus between liner 13 and casing 11. At this point, downward flow through passage 25 and past cement bushing 83 is blocked, however, requiring the returning circulation to flow up the annulus in casing 11 surrounding the drill pipe. The blockage past cement bushing 83 is caused by seals 97 now engaging enlarged surface 88, blocking flow in the annulus between upper body 85 and mandrel 19. Downward flow on the exterior of bodies 85, 95 is blocked by one-way seal element 101. Upward communication past plugs 123 is blocked by one-way seal 99. Passage 98 is blocked by the engagement of seals 97 with enlarged area 88 of mandrel 19.

To cement, the operator will pump cement in a conventional manner down the interior of the drill pipe, through mandrel 19, out the float shoe (not shown) at the bottom to return up the open hole annulus around liner 13 and the cased hole annulus in casing 11. At the beginning of cementing, a plug is placed in the drill pipe, and pumped down with the cement. The plug being pumped down contacts one of the plugs 123, pumping it to the bottom of the shoe where a pressure indication will be noted at the surface indicating that the cement is now being pumped through the cement shoe. The upward annular circulation at high pressure due to the pumping creates a large force on cement bushing 23 in an upward direction. Slips 91 in engagement with liner 13 prevent upward movement of cement bushing 83 as well as mandrel 19 and the drill pipe.

After the cementing operation has been completed and the operator wishes to retrieve running tool 17, he will pick up the drill pipe, causing mandrel 19 to move upward. Cement bushing 83 will remain in place initially because of slips 91 in engagement with cone 93. Furthermore, there will be frictional drag from one-way seals 99 and 101. Drag spring 111 tends to prevent movement of lower body 109 relative to liner 13. Split ring 119 will move upward with mandrel 19 and slide through the inner diameters of lower body 109, central body 95 and upper body 85, eventually snapping into recess 86. The body of check valve 121 will move upward with mandrel 19 only until it contacts lower body 109, at which time mandrel 19 continues moving upward. Once split ring 119 engages recess 86, continued upward movement will pull upper body 85 upward relative to central body 95 and lower body 109. Slips 91 will slide off of cone 93, disengaging cement bushing 83 from liner 13. Prior to removing cement bushing 83 from liner 13, the operator may circulate down the drill pipe with returns up casing 11 to wash out any cement in the area at the top of liner 13. This circulation is allowed once mandrel enlarged area 88 has disengaged from seals 97. The circulation flows past one-way seal 101, through port 98 and through the inner diameters of central body 95 and upper body 85.

The operator will then retrieve cement bushing 83. This is handled by lowering mandrel 19 to a point where split ring 21 engages shoulder 24. Upward pull then pulls collar 23 upward along with it. Only liner hanger 15 remains in place down hole.

In the event of loss of returns at the surface during cementing, the operator may wish to pump in reverse down casing 11. In this instance, he picks up mandrel 19 to free slips 91 in the same manner as if he is retrieving cement bushing 83. He then lowers mandrel 19. Split ring 119 will not disengage from recess 86, so slips 91 cannot set as they are moving downward with mandrel 19. Drag spring 111, however, remains stationary because of the engagement with liner 13. This causes slips 103 to grip liner 13. The enlarged area 122 adjacent split ring 119 is now in engagement with seals 97, blocking downward circulation in the inner annulus between bodies 85, 95 and mandrel 19. One-way seal 101 blocks downward circulation in the annulus between cement bushing 83 and liner 13. The operator may now pump in reverse down casing 11, with slips 105 preventing downward movement of cement bushing 83. The reverse flow passes down the annulus between casing 1 1 and liner 13.

Figure 8:
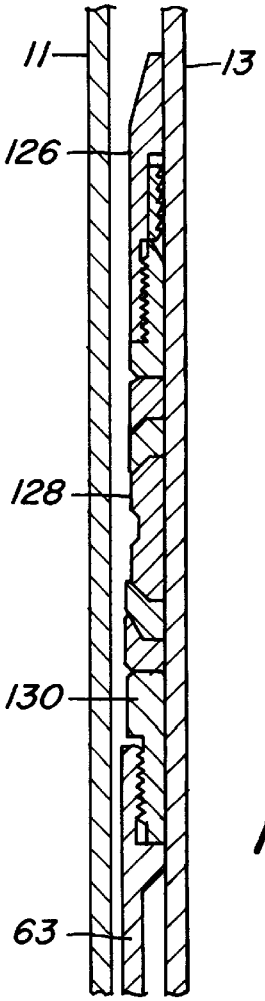
FIG. 8 is an sectional view of an optional packer for use with the apparatus of FIG. 1.

Referring to FIG. 8 in certain situations, an operator may wish to install a packer between liner 13 and casing 11. FIG. 8 shows one example wherein a packer 128 may be set after cementing has been competed and liner hanger 15 is being set. A slips assembly 126 with a cone-shaped upper end is rigidly secured to liner 13 at a point below slips 59. Slips assembly 126 allows upward movement of liner 13 relative to packer 128, but not downward movement. Slips assembly 126 will be located above tubular member 63. Packer 128 is carried below slips assembly 126 and above collar 130. Collar 130 replaces cone 61 (FIG. 5B) and is secured to tubular member 63 (FIG. 5B). When pulling liner 13 upward relative to slips 59 (FIG. 5A), the conical head of slips assembly 126 engages and forces slips 59 out into engagement with casing 11. Continued upward movement of liner 13 relative to slips assembly 126 occurs after slips 59 engage casing 11. After shear pin 67 (FIG. 5B) shears, as previously explained, continued upward movement of liner 13 moves tubular member 63 upward also. This movement is relative to slips assembly 126, causing packer 128 to set. Slips 126 prevent downward movement of liner 13 relative to slips assembly 126, permanently setting packer 128.

Figure 9:
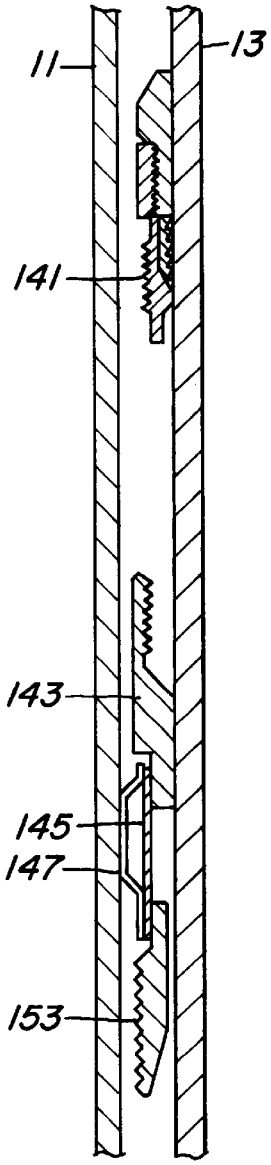
FIG. 9 is a sectional view of an alternate embodiment of part of the liner hanger of FIG. 1.

FIG. 9 illustrates another embodiment utilizing a different setting and retrieving assembly that gives options to the customer. In the first embodiment shown in FIGS. 5A, 5B, if prior to permanently setting collet slips 69, 73, it was necessary to retrieve liner 13, the drill pipe, mandrel 19 and liner 13 would be lowered to re-engage fingers 53 with slots 51 as in FIGS. 4 and 5A. In FIG. 9, a rotational means is provided for retrieving liner 13 if the setting action has started, but the collets slips 69, 73 (FIG. 5B) not yet wedged. In this embodiment, threaded member 141, which is rigidly attached to liner 13, will selectively engage a clutch sub 143 by right-hand rotation of the drill pipe and mandrel 19. Clutch sub 143 secures to a set of slips 153 by means of drag spring 147 and straps 145. Slips 153 operate in the same manner as slips 59 of FIG. 5A. When installed at the rig floor and during running-in, clutch sub 143 will not be connected to threaded member 141. The friction of springs 147 will cause clutch sub 143 to ride up against threaded member 141 as liner 13 is being lowered into the well. The setting of the liner hanger will proceed as in the other embodiment, except that no reciprocation of the drill pipe is needed to release clutch sub 143 from threaded member 143 prior to pulling the liner upward from bottom because it will be run in a released position. The upper wedge member 69 (FIG. 5B) will contact the slips 153, which grip casing 11 to prevent further upward movement. The setting action proceeds as described.

If it becomes necessary to retrieve liner 13 before setting collet slips 69, 73 (FIG. 5B), the driller lowers riser 13. Clutch sub 143 will remain stationary because of its frictional engagement with casing 11. While lowering, right-hand rotation is applied to the drill pipe, effecting a make up of clutch sub 143 and threaded member 141. Once these two components 143 and 141 are mated, the total assembly can be pulled from the well because slips 153 will now move upward in unison with liner 13.

Figure 10A:
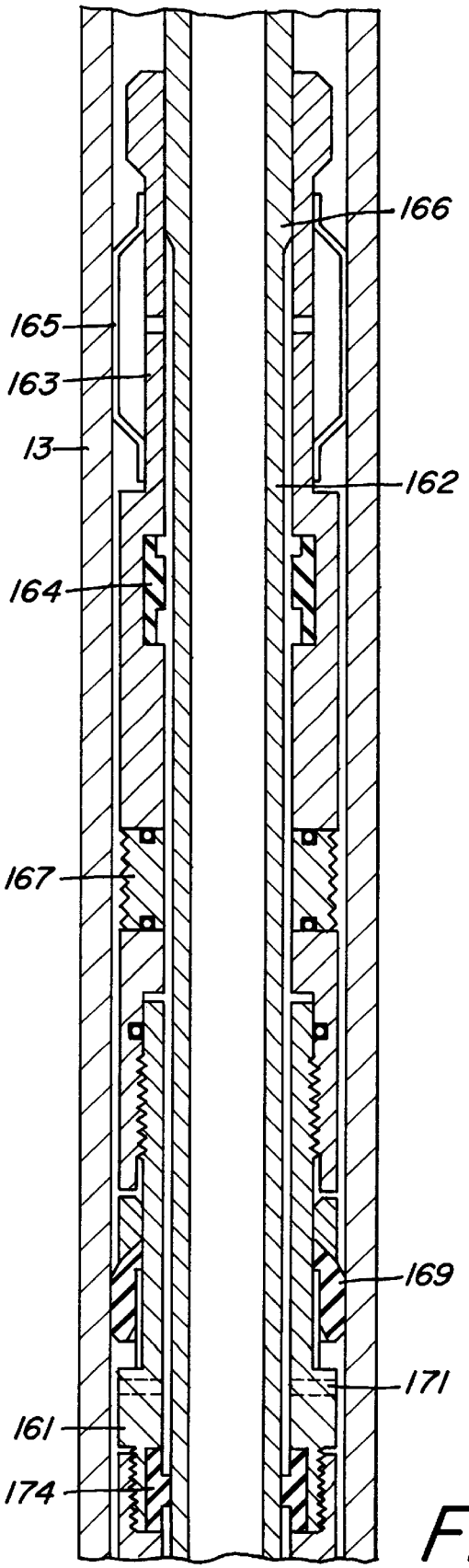
FIGS. 10A and 10B comprise a sectional view of an alternate embodiment for the cement bushing of FIG. 1.
Figure 10B:
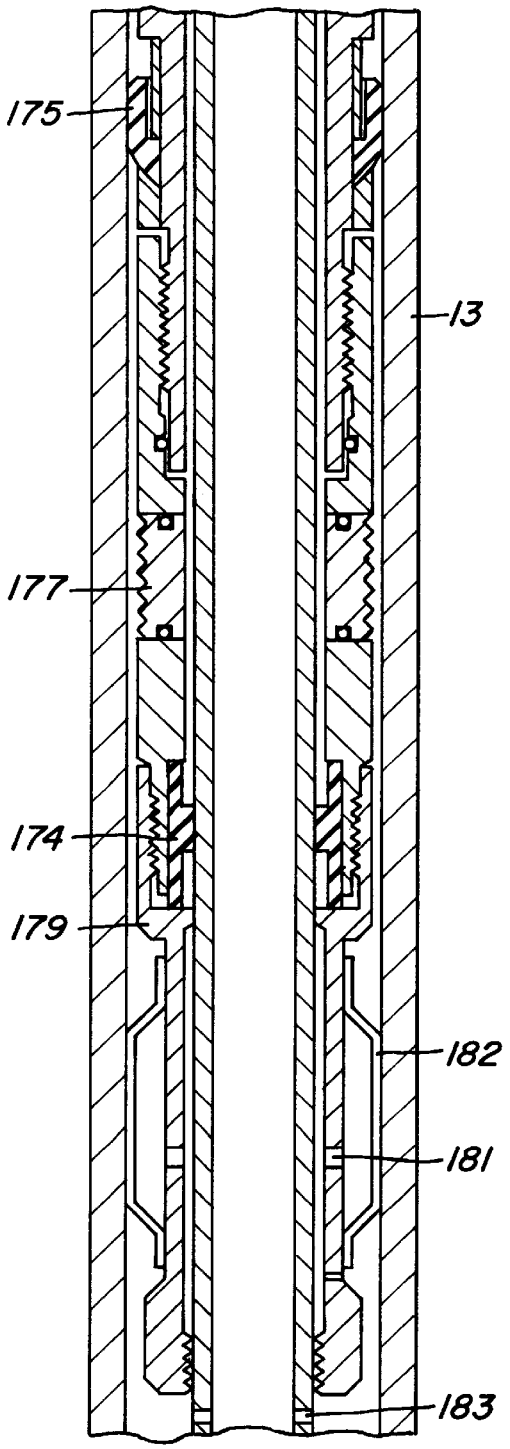

FIGS. 10A, 10B illustrates an alternate embodiment of cement bushing 83 (FIGS. 6A, 6B). Cement bushing 161 is hydraulically actuated rather than mechanically as in the first embodiment. However, there is no need to drop a ball or dart to activate. Cement bushing 161 is carried on a lower mandrel 162 which secures to mandrel 19 (FIG. 1A). Cement bushing 161 has an upper body 163 which has a drag spring 165. Fluid passages are provided between the interior of body 163 and mandrel 162. Seals 164 in body 163 do not seal against mandrel 162 when in the running-in position shown. Mandrel 162 has an enlarged area 166 which is located above seal 164 when in the running position, and which is engaged seals 164, 174 when in the set position. This opening and closing of the circulation path allows automatic fill up of the drill pipe while running liner 13 in the same manner as the first embodiment. After liner 13 is landed on bottom, and mandrel 162 is moved downward relative to body 163, seals 164, 174 of body 163 will engage and seal in the upper enlarged area 166, sealing off the flow passage to the interior of the mandrel 162.

A pair of pistons 167 are located in the section below drag spring 165. Pistons 167 are outwardly biased by coil springs (not shown) and have teeth on the outer sides to grip liner 13. Although not shown, pistons 167 are differential area pistons, which will exert a greater outward directed force than inward directed when the pressure below the total assembly 161 is greater than in the annular area between casing 13 and mandrel 162 above the tool. A one-way sealing element 169 allows downward flow but prevents upward flow. A central body 173 having inner seals 174 is secured to upper body 163. Central body 173 contains ports 171 and also has an inner annulus passage between it and mandrel 162. Another one-way sealing element 175 is located below one-way seal 169 and inverted from one-way seal 169. One-way seal 175 allows upward flow but prevents downward flow. Another piston section 177 is located below one-way sealing element 175. A lower body 179 having an inner seal 174 also is secured to central body 173. Lower body 179 has a port 181 and drag spring 182 which will frictionally engage liner 13. A check valve assembly 183 is secured to the lower end of lower mandrel 125. While running-in, check valve 183 allows the entry of fluid from the annular space around mandrel 125 to its bore, but not in reverse.

In the operation of cement bushing 161, after liner 13 is set, the operator slacks down the drill pipe, placing enlarged section 166 across all inner seals 164 and 174. Once this occurs all pressure pumping and fluid exits through drill pipe, through mandrel 162 and flows out the cement shoe (not shown) on the bottom of casing 13. The fluid pressure causes pistons 167, 177 to energize, move radially outward to grip liner 13 and hold cement bushing 161 in place. Subsequently, after cementing has been completed, straight pick up on the mandrel 162 will open up all sealed areas and position cement bushing 161 for retrieving.

The invention has significant advantages. In the preferred embodiment, no rotation, dropping balls or darts are needed to run and set the liner hanger and cement bushing, or to retrieve the running tool and cement bushing. In all embodiments, the liner is completely conventional and needs no special machining treatments to its upper end. In one embodiment, the setting of both the hanger as well as the cement bushing is handled entirely by axial movement with no rotation required. This allows a mechanical setting liner hanger to be used in highly deviated wells. The liner can be stroked during cementing. The liner can also be retrieved after reaching bottom without permanent setting of the liner hanger. The operator can optionally fill the drill pipe automatically while running-in. Several liner hangers may be used along the length of an overlap section to spread the load.

While the invention has been shown in several forms, it should be apparent to those skilled in the art that it is not so limited but is susceptible to various changes without departing from the scope of the invention.

We claim:

1. In a well having a casing extending along a well axis to a first depth, an assembly for encasing the well to a second depth, comprising:

a liner made up of a plurality of sections of pipe, the liner having a length selected to extend from the second depth upward and overlap a lower end of the casing;

a running tool having an upper end for connection to a string of drill pipe, the running tool being releasably connected to an upper end of the liner for running the liner into the well;

a upper wedge member mounted to the exterior of an upper section of the liner, the upper wedge member tapering inward in downward axial direction;

a lower wedge member mounted to the exterior of the upper section of the liner and tapering outward in an upward axial direction for overlapping sliding engagement with the upper wedge member, the upper and lower wedge members being mounted to the liner in an extended running-in position and selectively movable to a contracted position;

a retainer actuable by movement of the drill pipe after the liner reaches the second depth for releasing the wedge members from the extended position; and a stop member carried by the upper section of the liner and selectively movable from a running-in position wherein the stop member moves downward with the liner to a setting position wherein the stop member stationarily engages an inner diameter of the casing while the liner moves upward, the stop member being axially spaced from the upper wedge member during the running-in position and being contacted by the upper wedge member in the setting position after the retainer has been released, wherein continued upward movement of the liner causes the lower wedge member to slide and wedge against the upper wedge member, expanding one of the wedge members into the contracted position in gripping engagement with the casing.

2. The well according to claim 1 wherein the upper and lower wedge members have locking tapers for permanently locking to each other after reaching the contracted position.

3. The well according to claim 1 wherein at least one of the wedge members comprises a collet having cuts formed therein to allow radial expansion of said one of the wedge members.

4. The well according to claim 1 wherein at least one of the wedge members has teeth on an inner side for biting engagement with the upper section of the liner when in the contracted position.

5. The well according to claim 1 wherein the upper section of the liner is substantially identical to the other sections of the liner.

6. The well according to claim 1 wherein the retainer comprises:

a shear member which shears upon application of an axial force of selected magnitude tending to push the wedge members to the contracted position.

7. The well according to claim 1 wherein the stop member is released from the running-in position by upward and downward movement of the drill pipe and the liner after the liner reaches the second depth.

8. The well according to claim 1 wherein the stop member comprises:

a connector body mounted to the upper section of the liner for axial movement therewith, the connector body having an indexing slot formed therein which has at least one valley and an open lower end;

a drag spring member having an outward protruding spring which slidably engages the casing;

a finger mounted to the drag spring member, the finger being located in the valley of the slot while the liner is being run in; and wherein straight upward and downward movement of the drill pipe and the liner causes the finger to index through the slot and move out the open lower end, releasing the drag spring member from axial movement with the liner.

9. The liner hanger according to claim 1 wherein the retainer comprises:

a shear member which shears upon application of an axial force of selected magnitude.

10. In a well having a casing extending along a well axis to a first depth, an assembly for encasing the well to a second depth, comprising:

a liner made up of a plurality of sections of pipe, the liner having a length selected to extend from the second depth upward and overlap a lower end of the casing;

a liner hanger assembly for hanging the liner in the well, comprising:

an upper wedge member, the upper wedge member tapering inward in a downward direction;

a lower wedge member tapering outward in an upward direction for overlapping sliding engagement with the upper wedge member;

a fastener for mounting the lower wedge member to the liner for axial movement therewith, the wedge members being movable toward to each other from an extended running-in position to a contracted position;

a retainer which releasably retains the wedge members in the extended position for axial movement with the liner during running-in;

a drag spring member having an outward protruding spring for slidingly engaging an inner diameter of the casing;

a downward facing tapered surface on a lower end of the drag spring member;

an upward facing tapered surface on an upper end of the upper wedge member, one of the tapered surfaces being radially expansible and having gripping teeth on an exterior portion;

a connector for releasably connecting the drag spring member to the liner for downward movement therewith while running-in, the connector being selectively releasable by manipulation of the drill pipe to release the drag spring member from downward movement with the liner after the liner has reached the second depth of the well; and wherein subsequent upward movement of the drill pipe and the liner causes the tapered surface of the upper wedge member to move into contact with the tapered surface of the drag spring member, wedging the gripping teeth into engagement with the casing to stop further upward movement of the upper wedge member, and further upward pull on the drill pipe and the liner causes the retainer to release the wedge members from the extended position, and continuing upward movement moves the wedge members to the contracted position, wedging tightly between the liner and the casing.

11. The liner hanger according to claim 10 wherein the connector comprises:

a connector body mounted to the liner for axial movement therewith, the connector body having an indexing slot formed therein which has at least one valley and an open lower end;

a finger mounted to the drag spring member and extending upward, the finger being located in the valley of the slot while the liner is being run in; and wherein straight upward and downward movement of the drill pipe and the liner causes the finger to index through the slot and move out the open lower end, releasing the drag spring member from upward movement with the liner.

12. The liner hanger according to claim 10 wherein the wedge members have locking tapers for permanently locking to each other in the contracted position.

13. The liner hanger according to claim 10 wherein the wedge members comprise collets, each having cuts formed therein, and wherein one of the wedge members flexes radially outward when moving to the contracted position to grip the casing, and the other of the wedge members flexes radially inward to grip the liner.

14. The liner hanger according to claim 10 wherein the wedge members comprise collets, each having cuts formed therein, and wherein one of the wedge members has teeth on an exterior side and flexes radially outward when moving to the contracted position to grip the casing, and the other of the wedge members has teeth on an inner side and flexes radially inward to grip the liner.

15. In a well having a casing extending along a well axis to a first depth, an assembly for encasing the well to a second depth, comprising:

a liner made up of a plurality of sections of pipe, the liner having a length selected to extend from the second depth upward and overlap a lower end of the casing;

a liner hanger assembly for hanging the liner in the well, comprising:

an upper wedge member tapering inward in a downward direction;

a lower wedge member tapering outward in an upward direction for overlapping sliding engagement with the upper wedge member;

means for mounting the lower wedge member to the liner for axial movement therewith;

shear means for releasably securing the upper wedge member to the lower wedge member in an extended running-in position, and for shearing upon application of an axial shear force to allow the wedge members to move to a contracted position;

a drag spring member having a radially protruding spring for engaging an inner diameter of the casing;

a downward facing tapered surface on a lower end of the drag spring member;

an upward facing tapered surface on an upper end of the upper wedge member, one of the tapered surfaces being outwardly radially expansible and having gripping teeth on an exterior portion; and connector means for mounting the drag spring member to the liner for downward movement therewith above the wedge members during running-in and for allowing upward movement of the liner relative to the drag spring member after the liner has reached the second depth of the well, causing the tapered surface of the upper wedge member to move into contact with the tapered surface of the drag spring member, wedging the gripping teeth into engagement with the casing, and further upward pull on the drill pipe and the liner causes the shear means to shear and causes the lower wedge member to move upward relative to the upper wedge member to the contracted position, wedging the wedge members between the liner and the casing.

16. The liner hanger according to claim 15 wherein the connector means comprises:

a connector body mounted to the liner for upward and downward movement therewith, the connector body having an indexing slot formed therein which has at least one valley and an open lower end;

a finger mounted to the drag spring member and extending upward, the finger being located in the valley of the slot while the liner is being run in; and wherein straight upward and downward movement of the drill pipe and the liner causes the finger to index through the slot and move out the open lower end, releasing the drag spring member from upward and downward movement with the liner.

17. The liner hanger according to claim 15 wherein each of the wedge members comprises a collet having cuts formed therein, one of the collets being radially expansible for gripping engagement with the casing, the other of the collets being radially contractible for gripping engagement with the liner.

18. A method of installing a liner in casing in a well which has a well axis, the casing extending along the well axis to a first depth, the liner being made up of a plurality of sections of pipe, the liner having a length selected to extend from a second depth upward and overlap a lower end of the casing, the method comprising:

(a) mounting an upper wedge member to the exterior of the liner, and retaining the upper wedge member in a releasable running-in position for axial movement in unison with the liner;

(b) stationarily mounting a lower wedge member to an exterior of the liner in opposition to the upper wedge member and for axial movement in unison with the liner;

(c) mounting a stop member to the exterior of the liner above the upper wedge member for downward movement in unison with the liner as the liner moves downward through the casing; then (d) lowering the liner into the well on drill pipe;

(e) engaging an inner diameter of the casing with the stop member; then (f) moving the liner and thereby the upper wedge member upward into contact with the stop member while the stop member remains stationary; then (g) pulling upward on the liner, causing the upper wedge member to be released from the running-in position and freeing it from axial movement with the liner; then (h) continuing to move the liner upward, causing the lower wedge member to slide and wedge against the upper wedge member, expanding one of the wedge members into gripping engagement with the casing.

19. The method according to claim 18 wherein:

step (c) further comprises mounting the stop member to the liner for upward movement therewith; and step(e) further comprises releasing the stop member from the liner for upward movement therewith by straight upward pull and slacking off movement.

20. The method according to claim 18 wherein the upper wedge member is released from the running-in position in step (g) by shearing a shear pin which secures the upper wedge member in the running-in position.

* * * * *